United States Patent [19]

Sando et al.

[11] 4,345,385

[45] Aug. 24, 1982

[54] METHOD FOR CONTINUOUS DRYING OF A CLOTH AND AN APPARATUS THEREFOR

[75] Inventors: Yoshikazu Sando; Hiroshi Ishidoshiro, both of Wakayama, Japan

[73] Assignee: Sando Iron Works, Wakayama, Japan

[21] Appl. No.: 156,182

[22] Filed: Jun. 3, 1980

[30] Foreign Application Priority Data

| | | | |
|---|---|---|---|
| Jun. 14, 1979 | [JP] | Japan | 54-74968 |
| Sep. 26, 1979 | [JP] | Japan | 54-123473 |
| Oct. 20, 1979 | [JP] | Japan | 54-135423 |

[51] Int. Cl.[3] ..... F26B 3/04; F26B 13/06

[52] U.S. Cl. ..... 34/23; 34/34; 34/155; 34/159; 34/163; 34/241; 68/5 D

[58] Field of Search ..... 68/5 C, 5 D, 5 E; 34/23, 30, 34, 163, 155, 156, 229, 241, 159

[56] References Cited

U.S. PATENT DOCUMENTS

| | | | |
|---|---|---|---|
| 2,554,239 | 5/1951 | Caulfield et al. | 34/213 |
| 3,371,428 | 3/1968 | Thygeson, Sr. et al. | 34/216 |
| 3,810,315 | 5/1974 | Fleming | 34/160 |

*Primary Examiner*—Larry I. Schwartz

*Attorney, Agent, or Firm*—Toren, McGeady & Stanger

[57] ABSTRACT

For continuously drying a cloth, the cloth is subjected to a drying process in which high pressure dry hot air is jetted against the cloth in a zigzag pattern from both sides thereof while transporting the cloth continuously through a cloth passage. The cloth passage is a gap formed between a pair of horizontally extending parallel endless net conveyors located one above the other. In accordance with the rotation of the two conveyors the cloth is vigorously beat and vibrated as it passes through the gap in a snaky state under no tension to afford drying of the cloth. When the drying process is effected by stepwise lowering the temperature of the cloth, or is repeated by cooling the heated cloth in the open atmosphere, the drying resembles natural drying, preventing the cloth from becoming fragile, and moreover, in particular heat energy is saved. A cloth in a ropy state can also be dried satisfactorily and effectively by inserting a cloth untwisting process and a cloth expanding process prior to drying. The cloth is dried continuously and effectively in a short time, and the dried cloth has an excellent touch feeling with appropriate stretchability and shrinkability as well as bulkiness.

6 Claims, 4 Drawing Figures

METHOD FOR CONTINUOUS DRYING OF A CLOTH AND AN APPARATUS THEREFOR

BACKGROUND OF THE INVENTION

The present invention relates to a method and an apparatus for continuously drying a cloth effectively and in a short time.

In subjecting a long cloth to pretreatment or such treatment as industrial dyeing, the treatment must be finished by continuously drying the cloth after washing. For drying a cloth in such instances, conventionally such methods have been adopted as a cylinder drying method, in which a cloth to be dried is transported successively in contact with a plurality of heating cylinders, and a dry hot chamber drying method, in which a cloth is transported in a hanging state successively through a number of drying chambers and is heated respectively at a prescribed temperature.

However, in the cylinder drying method, since the cloth to be dried is guided in contact with heating cylinders, unavoidably the cloth is tension to prevent its shrinkability, so that the cloth is flattened as if ironed to deteriorate its touch feeling. In the dry hot chamber drying method, although the tension applied to the cloth is not as great as in the cylinder drying method, since the cloth is transported in a hanging state while it still contains water, the cloth is still unavoidably tensioned by its own weight, so that shrink drying (no tension drying) can hardly be done, particularly in the drying of a knitted cloth, and moreover, since the interior of the drying chamber must be kept at a high temperature, the heat energy consumption is enormous.

Particularly, in applying a centrifugal separator to remove washing water from a cloth after washing, which has been done particularly in treating a long cylindrical cloth in the usual way, the cloth after treatment is in a ropy state, folded and shrunk irregularly in the width direction of the cloth and twisted to some extent, so that it is necessary preliminarily to untwist and expand the cloth flat in order to perform uniform drying. Conventionally a cloth expanding process has been adopted to untwist and expand the cloth mechanically prior to drying, but in such an expanding process, since the transport speed of the cloth must be slowed down to untwist and expand the cloth, the efficiency of the process is very low.

SUMMARY OF THE INVENTION

The present invention is done in view of such circumstances. The object of the invention is to develop a method of continuously drying a cloth under no tension (shrink drying) to obtain an excellent touch feeling of the dried cloth. Another object of the invention is to provide a continuous drying apparatus for a cloth, which is simple in its construction and with which a cloth can be dried in a short time to save heat energy.

The essential point of the invention comprises subjecting a cloth to be dried to a drying process in a drying chamber, in which high pressure hot air is jetted against the cloth in a zigzag pattern from both sides while continuously transporting the cloth through a cloth passage, formed by a gap between a pair of horizontally extending parallel endless net conveyers spaced one above the other. As the two conveyers move they beat and vibrate the cloth that the cloth passes through the gap in a snaky state under no tension. Since the cloth travel in a snaky state through the cloth passage under no tension while receiving a strong jetting force of high pressure hot air from both sides, the cloth is continuously dried effectively in a short time. It is preferable that the drying process is done by lowering the temperature of the cloth stepwise, or the drying process is repeated by putting a process to cool the heated cloth in the open atmosphere therebetween. Drying proceeds similarly to natural drying, preventing that the cloth from becoming fragile, and moreover, the heat energy can be saved. Thus, the cloth obtained by using this invention has an excellent touch feeling, with appropriate stretchability and shrinkability as well as bulkiness.

When a cloth to be treated is in a ropy state, which occur in removing washing water from the cloth by using a centrifugal separator, the cloth is subjected successively to a process to untwist the cloth so as to render the cloth easily expandable and to another process to expand the cloth by jetting high pressure air against the cloth, prior to the drying process. The untwisting and expanding of the cloth is done speedily and surely as compared with the conventional mechanical method so that the following drying process can be done smoothly to obtain an excellent product.

BRIEF DESCRIPTION OF THE DRAWINGS

The present invention will be explained in detail in the following according to the drawings showing examples of the inventive apparatus.

DETAILED DESCRIPTION OF PREFERRED EMBODIMENTS

Example 1

Figure 1:
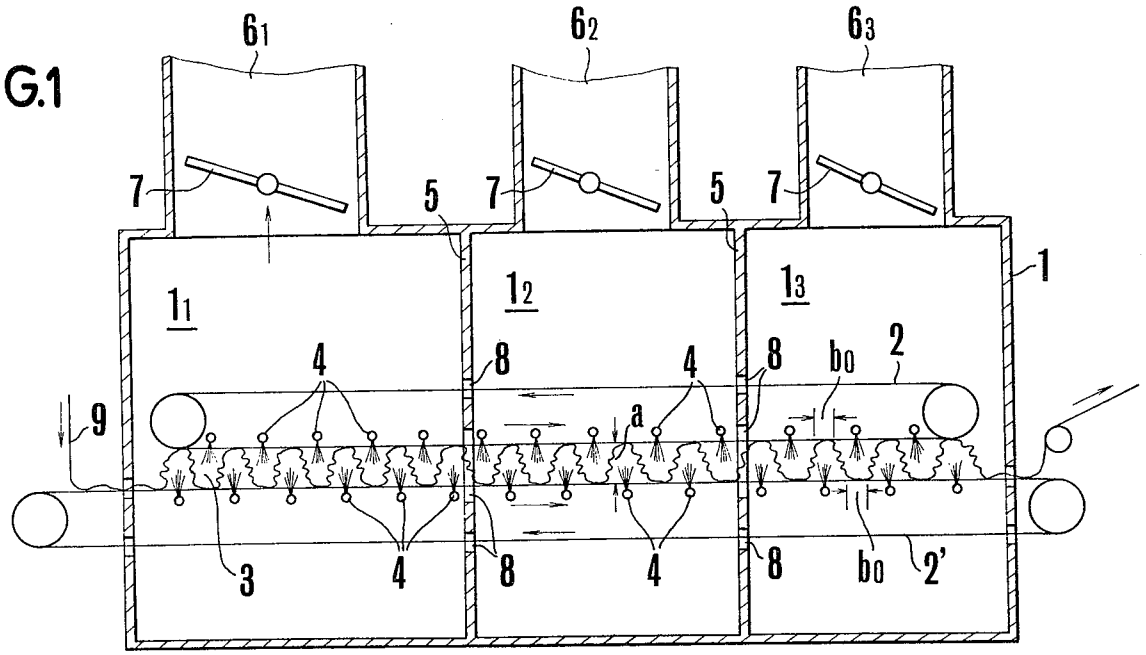
FIG. 1 is a sectional side view of an example of the inventive apparatus.

FIG. 1 shows an example of the present inventive apparatus for drying a long cloth continuously. In the figure, 1 is a drying chamber, which is divided into three sections $1_1$, $1_2$ and $1_3$. 2 and 2' are endless net conveyers. 3 is a cloth passage corresponding to a gap a, between the conveyors. 4 are jet nozzles. 5 are partition walls. $6_1$, $6_2$ and $6_3$ are exhaust cylinders. 7 are dampers. 8 are slits. 9 is a cloth. $b_o$ will be explained hereinafter.

In the drying chamber 1, the pair of endless net conveyers 2 and 2' having sufficient permeability are located one above the other and extend horizontally and in parallel forming a gap, a, therebetween to serve as the cloth passage 3. A plurality of jet nozzles 4 jet high pressure dry hot air against the opposite surfaces of the cloth along both outer sides of the cloth passage 3 by placing the jets outside the runs of the conveyers defining the cloth passage. The drying chamber 1 is divided into three sections, a high temperature section $1_1$, a medium temperature section $1_2$ and a low temperature section $1_3$, respectively with a partition wall 5 extending across the direction of movement of the cloth. The partition walls have slits 8 so as to pass the conveyers and the cloth continuously therethrough. It is desirable that the slits 8 are as narrow as possible in order for effectively maintaining the temperature gradient among the sections $1_1$, $1_2$ and $1_3$. $6_1$, $6_2$ and $6_3$ are exhaust cylinders to exhaust the wet heat formed by the drying of the cloth in the corresponding sections $1_1$, $1_2$ and $1_3$, each respectively fitted with a damper 7.

What is most important in the present invention is the height of the cloth passage 3, or the width of the gap, a, between the two net conveyers 2 and 2'. The width of the said gap should be determined so that the cloth is strongly vibrated, beaten and crumpled by jetting dry hot air against the cloth in a zigzag pattern from both sides while the cloth is passed through the gap in a snaky state.

Although an appropriate width of the gap depends on the kind of cloth to be treated whether it is thick or thin and on the jetting pressure of dry hot air, it is desirable to render the height of the snaky undulations of the cloth (corresponding to the width of the gap), which is formed by the jetting pressure of dry hot air while the cloth is passing through the gap between the two conveyers, as large as possible. This is because the cloth receives a strong vibration while the cloth is moved up and down to form snaky undulations, and the vibration is effective to spatter water from the cloth and to transfer the cloth under no tension. If the gap between the two conveyors is narrow, the length of the cloth moving up and down to form snaky undulations becomes short, giving no effective vibration. On the other hand, when the gap is too broad, the cloth does not contact the conveyor, so that not only does the cloth not form snaky undulations but it also floats up in the gap, and therefore, the cloth is not transferred smoothly in accordance with the movement of the two conveyors.

To establish an appropriate width of the gap, the relation between the width of the gap, $a_o$, and the area of the cloth contact the conveyor per one shanky undulation, $b_o$ (in terms of length), was determined experimentally by varying the kind of cloth to be treated. The jetting pressure of dry hot air and the pitch of the jet nozzles were kept constant. The result was as shown in Table 1.

| Conditions | | |
|---|---|---|
| Jetting speed | 48 m/sec. | |
| Temperature | 150° C. | |
| Pitch of jet nozzles | 350 mm | |
| Width of jet nozzles | 8 mm | |
| Clothes Tested: | Width cm | Length cm |
| No. 1 T/C Gabardine | 91.8 × | 103.9 |
| No. 2 T/C Weather | 90.6 × | 104.0 |
| No. 3 Cotton Gabardine | 92.6 × | 104.6 |
| No. 4 T/C Mixed Weave | 107.8 × | 100.7 |

TABLE 1

Test of the formation of snaky undulation

| Cloth | | Width of the gap, $a_o$ mm | | | | | |
|---|---|---|---|---|---|---|---|
| | | 20 | 50 | 100 | 150 | 200 | 250 |
| No. 1 | $b_o$ mm | 130 | 120 | 112 | 110 | 88 | 50 |
| No. 2 | $b_o$ mm | 143 | 115 | 110 | 110 | 95 | 60 |
| No. 3 | $b_o$ mm | 140 | 120 | 115 | 115 | 95 | 55 |
| No. 4 | $b_o$ mm | 140 | 120 | 110 | 100 | 85 | 65 |

To transport a cloth smoothly through the gap receiving strong vibrations to form snaky undulations under no tension and relaxed state, it was proved experimentally that the appropriate area of the cloth contact with the conveyor per one snaky undulation, $b_o$, was in the range from 120 to 85 mm in terms of length, and the cloth was suitably shrunk thereby to form fine crimps. Therefore, it is concluded that the appropriate gap width corresponding to the gap $b_o$ is in the range from 50 to 200 mm for a wide variety of the cloth to be treated.

Another feature of this apparatus is to lower the temperature of dry hot air to be jetted to a cloth stepwise in proportion to the decrease of water content of the cloth. While the cloth is passing through the high temperature section of the drying chamber $1_1$, dry hot air at a high temperature, for instance, about 150° C., is jetted against the cloth under a prescribed pressure. Water is speedily removed from the cloth containing a large amount of water. Wet heat formed in this period is exhausted through the exhaust cylinder $6_l$. The cloth dried tolerably in the high temperature section $1_1$ is transferred to the medium temperature section $1_2$ where the cloth is further dried by jetting dry hot air at a temperature, for instance, of about 100° C. Finally the cloth is dried completely inthe low temperature section $1_3$ by jetting dry hot air, for instance, at about 70° C. By lowering the temperature of dry hot air jetted against a cloth stepwise in proportion to the decrease of water content of the cloth in this way, drying proceeds similarly to natural drying, preventing the cloth from becoming fragile, and moreover, heat energy is saved.

Continuously drying a long cloth by using this apparatus is done, for example, as follows. By driving the two endless net conveyors 2 and 2' in the same direction, a cloth to be dried is supplied to the cloth passage 3 in the high temperature section, $1_1$, of the drying chamber while jetting dry hot air at a temperature about 150° C. against the cloth from the nozzles 4. Due to the jetting force of the dry hot air applied against the cloth in a zigzag pattern from both sides, the cloth traveling in a snaky state through the cloth passage is vibrated and struck to the two conveyors alterantely and repeatedly, and moreover, the temperature of hot air is sufficiently high, so that drying of the cloth proceeds effectively. Thus the partially dried cloth is transferred to the medium temperature section $1_2$ and receives a jetting force of dry hot air at a temperature about 100° C. The cloth moves similarly as in the high temperature section, and drying also proceeds effectively. Finally the cloth is dried completely in the low temperature section $1_3$ by jetting hot air at a temperature about 70° C. The drying in this section resembles natural drying, preventing the cloth from becoming fragile, and the cloth obtained has appropriate stretchability and shrinkability as well as bulkiness to give excellent touch feeling.

A further feature of the present invention is that, since a cloth is transported through the gap between the two parallel conveyors one about the other while jetting hot air against the cloth, it is possible to transport not only a long cloth but also a series of fragmentary cloths continuously through the effectively drying chamber for the drying thereof.

EXAMPLE 2

Figure 2:
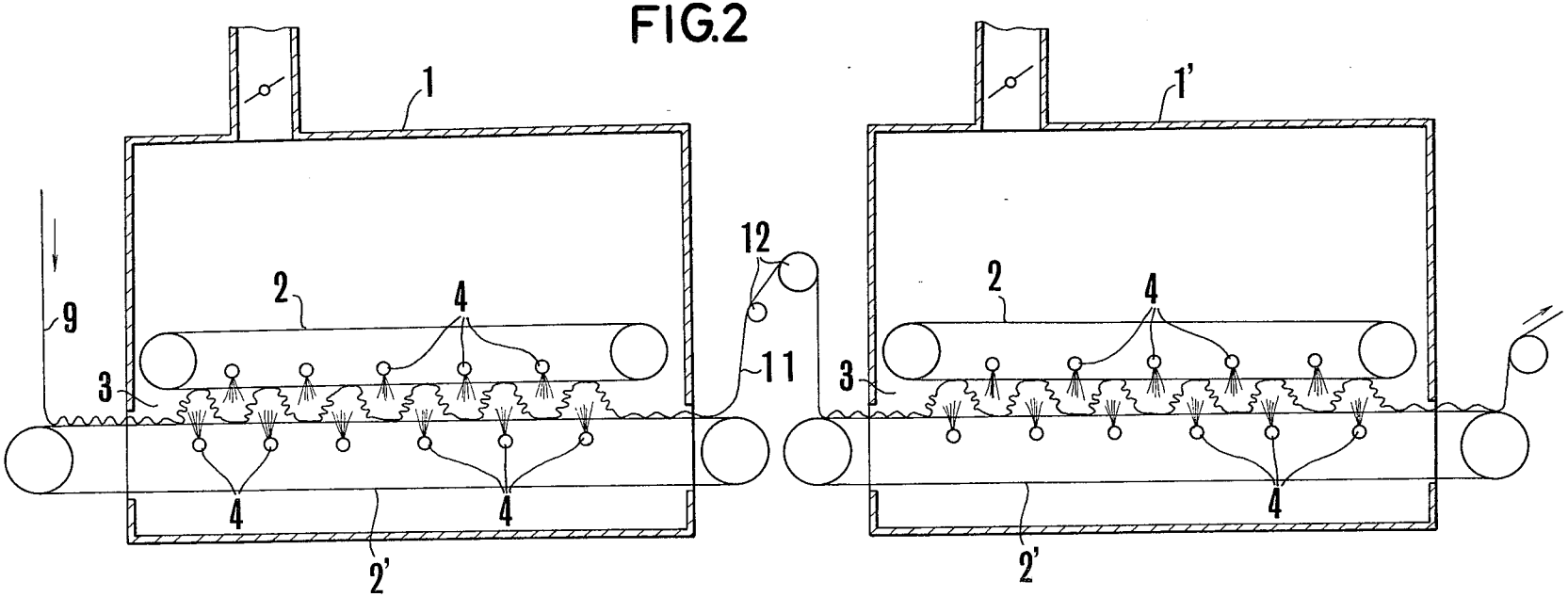
FIG. 2 is the same of another example of the inventive apparatus in which the drying process is done in two separate drying chambers in succession.

Another example of the present invention apparatus shown in FIG. 2 is to carry out the drying of a cloth in two separate drying chambers 1 and 1' by putting a cooling device 11 for of the cloth, between the chambers to cool the cloth in an open atmosphere. 12 are guide rollers for transporting the cloth in the cooling device. Other notations in the figure are the same as in FIG. 1 The height of the cloth passages 3 in both of the drying chambers 1 and 1' are, respectively, in the range of 50 to 200 mm as in Example 1.

A cloth to be dried is supplied to the cloth passage in the drying chamber 1, and the cloth is dried by jetting dry hot air as in the preceding example. Since the cloth to be dried contains a tolerable amount of water, the humidity in the chamber is elevated deteriorating the drying efficiency. In this example, therefore, the cloth is then passed through the cooling device 11 in an open air with the aid of the guide rollers 12, where water at a high temperature contained in the cloth is evaporated effectively. The thus cooled cloth is transported through the drying chamber 1' while jetting high pressure hot air, desirably at a temperature lower than in the drying chamber 1, against the cloth to complete drying. Drying is done effectively in a relatively low wet heat atmosphere. Under certain circumstances, similar drying and cooling processes may be repeated to dry a cloth more effectively and speedily. The apparatus in this example is particularly suitable when the cloth contains a large amount of water.

EXAMPLE 3

Figure 3:
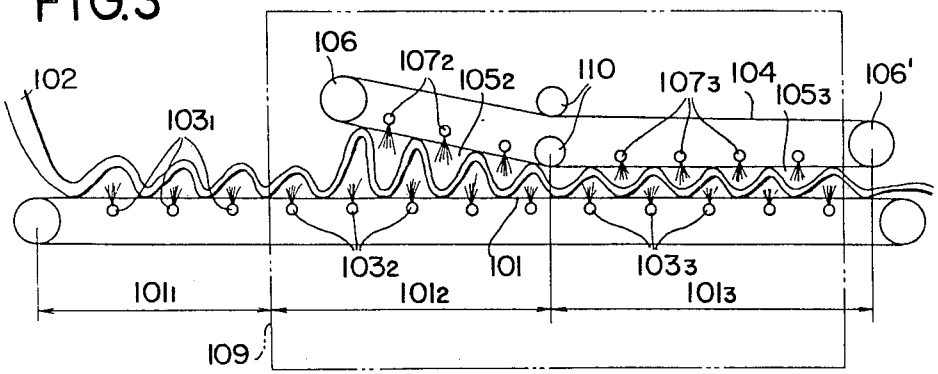
FIG. 3 is a sectional side view of a further inventive apparatus in which an untwisting device and an expanding device of the cloth are positioned ahead of the drying chamber.
Figure 4:
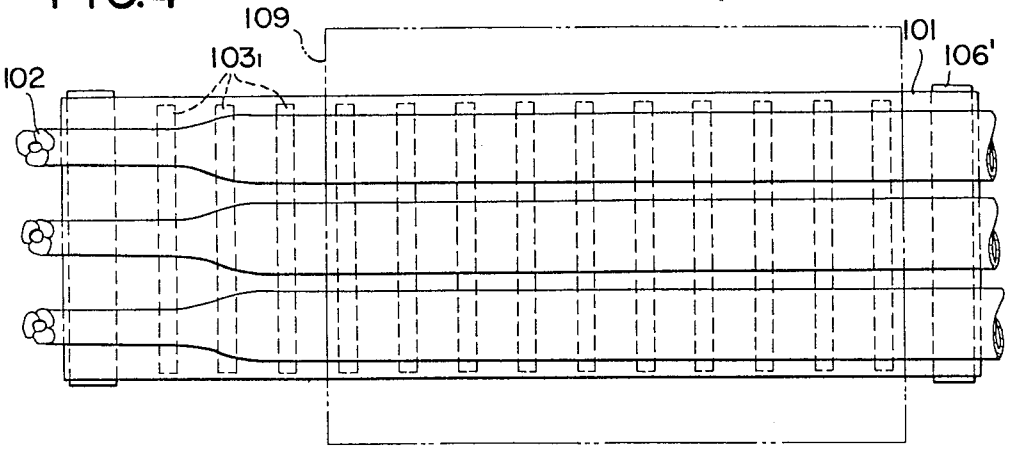
FIG. 4 shows how the cloth is untwisted and expanded.

A further example of the present inventive apparatus shown in FIGS. 3 and 4 provides an untwisting device for a cloth and an expanding device lcated ahead of the drying chamber. This type of drying apparatus is particularly suitable, as above mentioned, for drying a cloth in a ropy state which is encountered frequently in drying a long cylindrical cloth.

In these figures, 101, is an endless net conveyer, 102 is a cloth to be dried, $\mathbf{103_1}$, $\mathbf{103_2}$, and $\mathbf{103_3}$ are jet nozzles, 104 is an endless net conveyor $\mathbf{105_2}$ and $\mathbf{105_3}$ are cloth passages, 106 and 106' are support rollers, $\mathbf{107_2}$ and $\mathbf{107_3}$ are jet nozzles, 108 is a pair of guide rollers and 109 is a cover.

In FIG. 3, an endless net conveyer 101 transports a cloth 102 by mounting the cloth thereon. The moving direction of this conveyer comprises three parts, one for the untwisting process of the cloth $\mathbf{101_1}$, a second for the expanding process $\mathbf{101_2}$ and a third for the drying process $\mathbf{101_3}$. For each of the parts, a plurality of jet nozzles $\mathbf{103_1}$, $\mathbf{103_2}$ and $\mathbf{103_3}$ are provided extending across the direction of movement of the cloth along the conveyor 110 for jetting high pressure air against the cloth. 104 is another endless net conveyer provided above the lower side net conveyer 1 at the position corresponding to the cloth expanding part $\mathbf{101_2}$ and the cloth drying part $\mathbf{101_3}$, forming cloth passages $\mathbf{105_2}$ and $\mathbf{105_3}$ therebetween. Support rollers 106 and 106' for the upper side conveyor, 104, are designed so as to move up and down for the purpose of controlling the width of the cloth passage $\mathbf{105_2}$ and $\mathbf{105_3}$. Particularly, as shown in FIG. 3 the width of cloth passage $\mathbf{105_2}$ for the cloth expanding part $\mathbf{101_2}$ can be narrowed in the direction from the inlet to the outlet of the cloth. $\mathbf{107_2}$ and $\mathbf{107_3}$ are a plurality of jet nozzles provided across the cloth along the net conveyer 104, in a manner zigzag to the jet nozzles $\mathbf{103_2}$ and $\mathbf{103_3}$, for jetting high pressure air against the cloth. 108 is a pair of guide rollers for the upper side net conveyer 104, and 109 is a cover.

In this apparatus, a plurality of ropy cloths can be simultaneously treated in parallel in accordance with the widths of the net conveyers 101 and 104. FIG. 4 illustrates how the cloth is untwisted and expanded in treating three cloths en bloc.

When a cloth in a ropy state 102, is transported by mounting it on the net conveyer 101, while receiving a jetting force of high pressure air jetted intermittently from jet nozzles 103, in the cloth untwisting part 101, the cloth is vibrated strongly up and down on the conveyer 101 to untwist and flatten the cloth. The thus flattened cloth receives a jetting force of high pressure air, desirably at a high temperature, zigzag from both sides thereof from jet nozzles $\mathbf{103_2}$ and $\mathbf{107_2}$ in the cloth expanding part $\mathbf{101_2}$, so that the cloth is vibrated to form snaky undulations. Furthermore, since the width of the cloth passage $\mathbf{105_2}$ is broad at the early stage of the cloth expanding part $\mathbf{102_2}$, the height of the snaky undulations of the cloth is large to expand the cloth in the width direction thereof easily, and thus the cloth is completely expanded towards the end of the cloth expanding part. Finally, the cloth, thus completely expanded is dried effectively under a no tension, relaxed state by jetting high pressure hot air against the cloth from both sides in the cloth drying part $\mathbf{101_3}$ to render the cloth excellent in its touch feeling as in the preceding examples. This type of apparatus is particularly suitable for the drying of a knitted cloth.

As above explained in detail, the present invention is to subject a cloth to be dried to a drying process in a drying chamber, in which high pressure hot air is jetted across the cloth in a zigzag pattern from both sides while transporting the cloth continuously through a gap formed between a pair of parallel endless net conveyers located one about the other as the two conveyers are driven to beat and vibrate the cloth strongly so as to pass the cloth therethrough in a snaky state under no tension. Since the cloth passes through the gap in a shakey state gap under no tension while receiving a strong jetting force of high pressure hot air in a zigzag manner from both sides thereof, the cloth is continuously dried effectively in a short time.

When the drying process is performed by lowering the temperature of the cloth stepwise, or is repeated by putting a process to cool the heated cloth in the open atmosphere therebetween, the drying resembles natural drying, preventing that the cloth from becoming fragile, and moreover, heat energy is particularly saved. A cloth in a ropy state can also be dried satisfactorily and effectively by placing a cloth untwisting process and a cloth expanding process ahead of the drying process.

The cloth dried in the present invention has simultaneously an excellent touch feeling with appropriate stretchability and shrinkability as well as bulkiness.

What is claimed is:

1. A method of continuously drying a cloth comprising transporting the cloth through a cloth passage defined by a pair of endless net conveyers arranged one above the other in parallel, drying the cloth using high pressure dry hot air and jetting the dry hot air from nozzles against the cloth, arranging the nozzles extending transversely of the direction of movement of the cloth through the cloth passage on opposite sides of the cloth and offset relative to one another so that the nozzles are disposed above and below the cloth passage in a zigzag manner, and driving the two conveyers so that the combination of the movement of the cloth and the jetting action of the dry hot air effects beating and vibrating of the cloth as the cloth passes through the cloth passage in a snaky state under no tension for drying of the cloth, dividing the cloth passage into at least three separate chambers arranged one after the other in the direction of movement of the cloth and drying the cloth in the first chamber at about 150° C., drying the cloth in the second chamber at about 100° C., and drying the cloth in the third chamber at about 70° C., prior to said drying process, with the cloth in a ropy state, moving the cloth generally horizontally and untwisting the cloth in the ropy state by jetting high pressure air against the cloth from below, and then expanding the cloth by jetting high pressure air against the cloth zigzag from above and below from nozzles extending transversely of the direction of movement of the cloth.

2. A method of continuously drying a cloth as set forth in claim 1, including cooling the heated cloth in an open atmosphere.

3. A method of continuously drying a cloth as set forth in claim 1, forming the dimension of the cloth passage between the opposite sides defined by the net conveyers in the range of 50 to 200 mm.

4. An apparatus for continuously drying a cloth comprising a drying chamber, a pair of endless net conveyers located within said drying chamber and arranged horizontally and in parallel one above the other and forming a gap therebetween serving a cloth passage, a plurality of jet nozzles above and below said net conveyers defining said cloth passage with said jet nozzles extending transversely of the direction of movement of the cloth through the cloth passage and with the nozzles above and below the cloth passage offset relative to one another providing a zigzag arrangement so as to jet high pressure air against the cloth, a plurality of partitions located within said drying chamber and extending transversely of the direction of movement of the cloth through said chamber and dividing said chamber into a number of subchambers, said partitions having openings therethrough for passing said net conveyers and the cloth therethrough, and supplying high pressure dry hot air to said nozzles in each of said subchambers for drying the cloth in the first subchamber as the cloth enters said drying chamber at a temperature of about 150° C. in the next subchamber at a temperature of 100° C. and in the following subchamber at a temperature of 70° C. for lowering the temperature in a stepwise manner as the cloth passes through said drying chamber, an endless net conveyer located upstream from said net conveyers passing through said drying chamber, the upstream said net conveyer being arranged to transport a ropy cloth to said drying chamber, the upstream said net conveyer comprising three parts, a first part for untwisting the cloth, a second part for expanding the cloth, and a third part for drying the cloth, another endless conveyer provided between the upstream said net conveyer and said drying chamber and said another endless net conveyer located above the upstream said net conveyer for a downstream portion thereof with said another net conveyer located above the part of said upstream conveyer for expanding the cloth and for drying the cloth and forming a gap with said parts serving as a cloth passage passing to said drying chamber, and a plurality of jet nozzles arranged above and below the cloth passage between the upstream said net conveyer and said another net conveyer with said jet nozzles extending transversely across the direction of movement of the cloth through the cloth pressure and arranged offset relative to one another above and below the cloth passage for providing a zigzag arrangement of said nozzles for jetting high pressure air to the cloth passing through the cloth passage.

5. An apparatus for continuously drying a cloth as set forth in claim 4, including means forming an open space between adjacent said subchambers with said space being open to the atmosphere for cooling the cloth in the open space as it passes from one subchamber to another.

6. An apparatus for continuously drying a cloth, as set forth in claim 4, wherein said endless net conveyers within said drying chamber being spaced apart from one another in the range of 50 to 200 mm.

* * * * *